US006659369B1

(12) United States Patent
Foster et al.

(10) Patent No.: US 6,659,369 B1
(45) Date of Patent: Dec. 9, 2003

(54) HIGH VISCOSITY LIQUID SPRAYER NOZZLE ASSEMBLY

(75) Inventors: Donald D. Foster, St. Charles, MO (US); Philip L. Nelson, Wildwood, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 0 days.

(21) Appl. No.: 10/170,032

(22) Filed: Jun. 12, 2002

(51) Int. Cl.[7] ..... A62C 5/02; A62C 11/00; B05B 7/26; B05B 9/043; B05B 1/34

(52) U.S. Cl. ..... 239/333; 239/310; 239/482

(58) Field of Search ..... 239/569, 570, 239/571, 601, 333, 483, 461, 464, 482, 488, 489, 490, 491, 493, 495, 496, 497, 499

(56) References Cited

U.S. PATENT DOCUMENTS

| | | | | | |
|---|---|---|---|---|---|
| 872,920 | A | * | 12/1907 | Farley | |
| 3,590,775 | A | * | 7/1971 | Barr | 118/5 |
| 3,924,811 | A | * | 12/1975 | Lynex et al. | 239/91 |
| 4,452,379 | A | * | 6/1984 | Bundschuh | 222/207 |
| 4,624,413 | A | * | 11/1986 | Corsette | 239/333 |
| 5,067,655 | A | * | 11/1991 | Farago et al. | |
| 5,267,692 | A | * | 12/1993 | Maas et al. | 239/333 |
| 5,358,179 | A | * | 10/1994 | Lund et al. | 239/333 |
| 5,397,060 | A | * | 3/1995 | Maas et al. | 239/333 |
| 5,458,289 | A | * | 10/1995 | Cater | 239/119 |
| 5,492,277 | A | * | 2/1996 | Tani et al. | 239/585.5 |
| 5,664,733 | A | * | 9/1997 | Lott | 239/429 |
| 5,687,877 | A | * | 11/1997 | Smolen, Jr. | 222/1 |
| 5,740,967 | A | * | 4/1998 | Simmons et al. | 239/494 |
| 6,234,412 | B1 | * | 5/2001 | von Schuckmann | 239/333 |
| 6,241,165 | B1 | * | 6/2001 | Bickart et al. | 239/491 |
| 6,371,389 | B1 | * | 4/2002 | Bickart et al. | 239/491 |

* cited by examiner

*Primary Examiner*—Kevin Shaver
*Assistant Examiner*—Anuradha Ramana
(74) *Attorney, Agent, or Firm*—Thompson Coburn LLP

(57) ABSTRACT

A nozzle assembly for a handheld and hand operated liquid trigger sprayer includes a nozzle housing and a flow control member contained in the nozzle housing. The nozzle housing has an oblong liquid discharge orifice and a plurality of liquid breakup channels that radiate outwardly from the orifice. The flow control member has a head with a conical surface that engages over the liquid breakup channels and together they break up a flow of viscous liquid into separate liquid streams that impact with each other at the entrance to the discharge orifice and the liquid is discharged from the nozzle orifice in a narrow, fan spray pattern of the viscous liquid.

27 Claims, 4 Drawing Sheets

HIGH VISCOSITY LIQUID SPRAYER NOZZLE ASSEMBLY

BACKGROUND OF THE INVENTION (1) Field of the Invention

The present invention pertains to a nozzle assembly for a hand held and hand operated liquid sprayer typically called a trigger sprayer. In particular, the present invention pertains to a nozzle assembly for a trigger sprayer employed in dispensing viscous liquids. The nozzle assembly produces enhanced dispersion and uniformity in the spray pattern of the viscous liquid dispensed by the trigger sprayer.

(2) Description of Related Art

Hand held and hand operated liquid sprayers commonly known as trigger sprayers are well known in the liquid sprayer art. Trigger sprayers are commonly used to dispense household cleaning or cooking liquids in a stream or spray pattern of the liquid. A trigger sprayer is typically connected to a plastic bottle containing the liquid dispensed by the trigger sprayer.

A typical trigger sprayer is comprised of a sprayer housing that is connected to a neck of the bottle by either a threaded connection or a bayonet-type connection.

The sprayer housing is formed with a pump chamber, a liquid discharge passage communicating with the pump chamber and a liquid supply passage communicating with the pump chamber.

A piston is mounted in the pump chamber for reciprocating movements of the piston between charge and discharge positions. A spring is usually provided on the sprayer housing for biasing the piston toward its charge position.

A trigger is mounted on the sprayer housing by a pivot connection at one end of the trigger. The trigger is also connected to the pump piston. Repeating the sequence of manually squeezing the trigger toward the sprayer housing against the bias of the pump spring and then releasing the trigger, oscillates the trigger about its pivot connection and reciprocates the pump piston between its charge and discharge positions relative to the pump chamber.

A pair of check valves or one way valves are positioned in the sprayer housing, one between the pump chamber and the liquid discharge passage and one between the pump chamber and the liquid supply passage. The liquid supply passage includes a dip tube that extends from the sprayer housing into the interior of the bottle, communicating the liquid contained in the bottle through one of the check valves to the pump chamber.

A nozzle assembly having a discharge orifice is assembled to the liquid discharge passage. The liquid discharge passage usually contains a liquid spinner assembly. The spinner assembly has a liquid spinner head at one end adjacent the nozzle orifice and the second of the check valves at its opposite end. The spinner assembly check valve controls the liquid flow from the pump chamber to the liquid discharge passage and prevents the reverse flow.

From the manual oscillating movement of the trigger that reciprocates the pump piston in the pump chamber, the liquid is drawn from the bottle through the dip tube to the pump chamber. The liquid is then pumped from the pump chamber through the liquid discharge passage and through the liquid spinner and discharge orifice and is dispensed from the trigger sprayer in a conical spray pattern.

The typical trigger sprayer described above is well suited for dispensing liquids having a viscosity similar to that of water, for example various types of cleaning liquids. However, when the sprayers are employed in dispensing more viscous liquids like cooking oil, problems are encountered.

With the limited dimensions of the swirl chamber at the head of the spinner assembly and the limited size of the nozzle orifice, an adequate spin cannot be produced in the more viscous liquids dispensed through the typical trigger sprayer to produce an acceptable discharge pattern of the liquid sprayed from the sprayer. Other types of sprayer nozzle assemblies have been developed for more viscous liquids. These other types of sprayer nozzle assemblies do not include a spinner assembly with a swirl chamber that spins the liquid prior to its discharge from the nozzle orifice. Instead, viscous liquid sprayers typically employ a plurality of angled discharge orifices, often two orifices, that direct streams of the viscous liquid discharged from the trigger sprayer at an angle toward each other. The streams of the liquid impact with each other and are dispersed in a spray pattern. However, because the impacting streams of viscous liquid and the spray pattern they produce are outside the discharge orifices of the sprayer nozzle, the sprayer nozzle has no control over the spray pattern produced and the spray pattern of the viscous liquid is often non-uniform.

SUMMARY OF THE INVENTION

The shortcomings of the prior art high viscosity liquid trigger sprayer are overcome by the sprayer nozzle assembly of the present invention which produces a more uniformly dispersed spray pattern of viscous liquids discharged by the nozzle assembly. The trigger sprayer with which the nozzle assembly of the invention is used is formed in the typical configuration including a pump chamber, a liquid discharge passage communicating with the pump chamber, and a liquid supply passage communicating with the pump chamber. A dip tube is assembled to the liquid supply passage and extends into the interior of the bottle when the trigger sprayer is attached to the bottle. The pump piston is mounted in the pump chamber for reciprocating movement of the piston. The trigger is mounted on the trigger sprayer for pivoting movement relative to the sprayer. The trigger is also connected to the pump piston to cause the pump piston to reciprocate between its charge and discharge positions in the pump chamber in response to manual manipulation of the trigger. The trigger sprayer also contains a pair of check valves, one controlling the flow from the dip tube to the pump chamber and preventing the reverse flow. The high viscosity liquid sprayer nozzle assembly of the invention is designed to be used with many types of manual hand held and operated sprayers having this typical construction.

The nozzle assembly of the invention is basically comprised of a nozzle housing containing a flow control member, where the nozzle housing is constructed to be assembled to the liquid discharge passage of most constructions of trigger sprayers. In the preferred embodiment, the nozzle housing and flow control member are both constructed of plastic.

The nozzle housing of the invention has a liquid conduit having a length with opposite upstream and downstream ends. The liquid conduit is dimensioned so that it can be easily attached to the liquid discharge passage of a typical trigger sprayer. The conduit contains a liquid passage having opposite upstream and downstream ends. When assembled to the trigger sprayer, the upstream end of the liquid passage communicates with the liquid discharge passage of the trigger sprayer.

The nozzle housing also has an orifice wall at the downstream end of the liquid conduit. An interior surface of the orifice wall that faces the conduit liquid passage has an axially recessed cavity at its center. A discharge orifice passes through the orifice wall at the center of the cavity. The discharge orifice has a cross-section area with an oblong, preferably rectangular shape.

The interior surface of the orifice wall is conical. A plurality of radial slots are provided in the orifice wall conical surface and extend between the conduit interior surface and the orifice wall cavity, defining a plurality of liquid flow channels that are circumferentially arranged around the recessed cavity.

The flow control member has an axial length with opposite upstream and downstream ends and is positioned in the liquid conduit of the nozzle housing. The flow control member has an elongate stem extending along its length with a flow control head at the downstream end and a valve element at the upstream end of the member. The valve element is designed to seat over an inlet opening to the liquid discharge passage of the trigger sprayer with which the nozzle assembly of the invention is used. In the preferred embodiment, the valve element is a diaphragm or disk valve, although other types of valves may be employed. The flow control head has a conical surface that projects to an apex at the extreme downstream end of the flow control member. With the flow control member positioned in the liquid conduit of the nozzle housing, the conical surface of the head engages against the conical surface of the orifice wall and covers over portions of the plurality of liquid flow channels formed by the slots in the orifice wall. The apex of the flow control head is positioned in the recessed cavity in the orifice wall and is centered relative to the orifice.

In operation of the trigger sprayer employing the nozzle assembly of the invention, viscous liquid pumped from the pump chamber of the sprayer passes through the liquid discharge passage of the trigger sprayer and past the valve element of the flow control member into the liquid conduit of the nozzle housing. The valve element functions to prevent the reverse flow of liquid from the liquid conduit back to the pump chamber. The liquid is pumped through the liquid conduit to the flow control head at the downstream end of the flow control member. The periphery of the flow control head directs the flow of liquid around the head and the conical surface of the flow control head directs the flow of liquid through the plurality of liquid flow channels formed by the radial slots in the orifice wall. Thus, the flow control head and the plurality of liquid flow channels formed by the slots initially break up the flow of viscous liquid into several streams spacially arranged around the orifice and moving toward the orifice. These several separate streams are further directed by the conical surface of the flow control head and the pluralities of liquid flow channels past the apex of the flow control head to a position where the pluralities of streams impact or collide with each other. The position of the point of collision of the plurality of streams is inside the recessed cavity in the orifice wall and at the center of the entrance to the orifice in the orifice wall. The dispersion of the plurality of separate streams of liquid colliding with each other at the entrance of the orifice is shaped by the oblong configuration of the orifice as the liquid dispersed by the collision of the plurality of streams passes through the orifice. The oblong or rectangular configuration of the orifice forms the dispersion pattern of the liquid into a narrow fan spray pattern oriented uprightly or vertically relative to the trigger sprayer held in the hand of the user.

By the operation of the novel construction of the liquid spray nozzle assembly of the invention described above, the nozzle assembly disperses viscous liquid in a uniform fan sprayed pattern that is easily employed by a user of the nozzle assembly of the invention to direct the spray of viscous fluid where desired.

DESCRIPTION OF THE DRAWINGS

Further features of the invention are revealed in the following detailed description of the preferred embodiment of the invention and in the drawing figures wherein.

DETAILED DESCRIPTION OF THE PREFERRED EMBODIMENT

Figure 1:
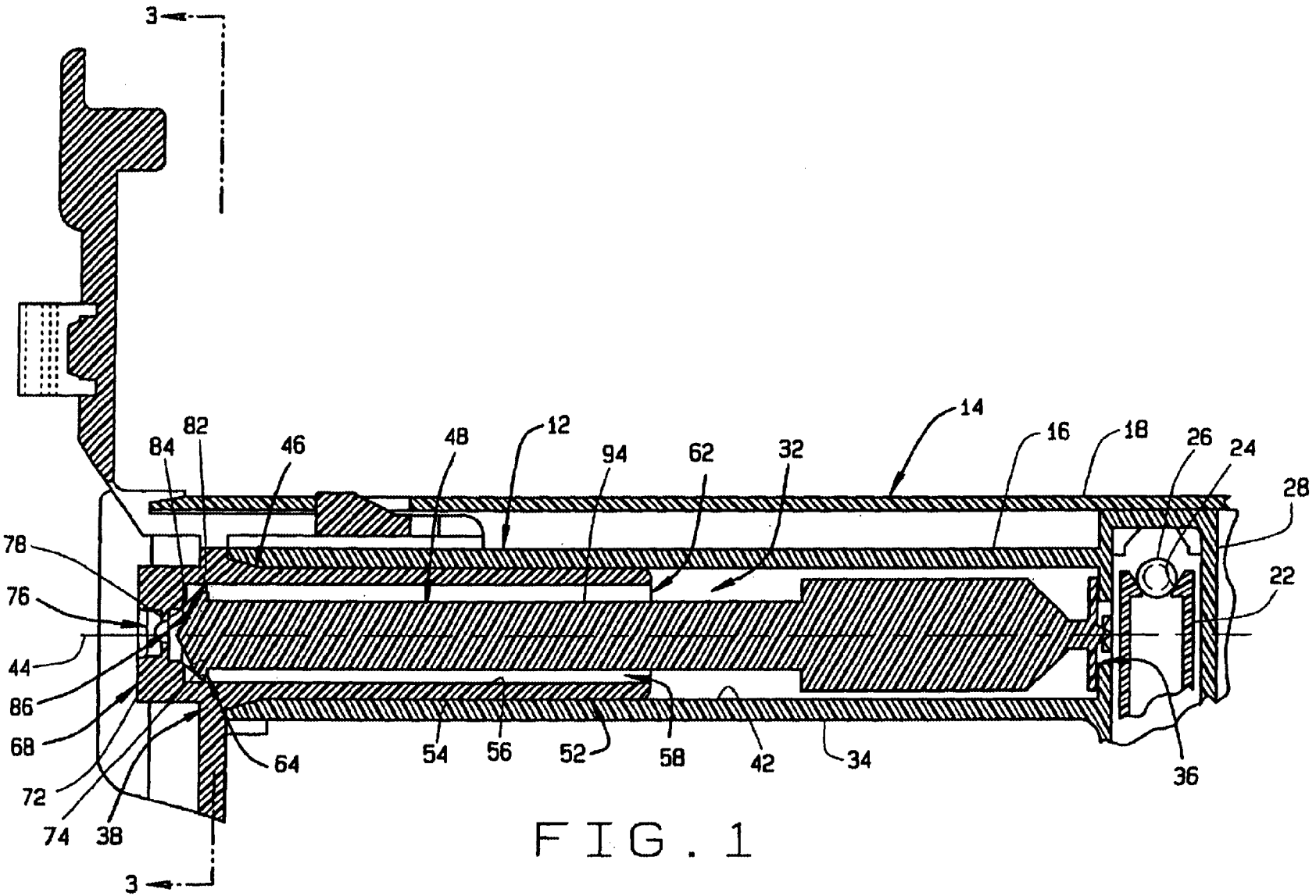
FIG. 1 is a side sectioned view of the viscous liquid sprayer nozzle assembly of the invention employed on the liquid discharge passage of a typical hand held and operated trigger sprayer.

FIG. 1 is a partial, side-sectioned view of a sprayer apparatus comprising the nozzle assembly 12 of the present invention assembled to a conventional trigger sprayer 14 of the type disclosed in U.S. Pat. No. 4, 958,754, assigned to the assignee of the present invention and incorporated herein by reference. Generally, the portions of the trigger sprayer shown in FIG. 1 include a portion of the trigger sprayer housing 16 and a portion of a covering shroud 18 assembled over the housing. Because the constructions of conventional trigger sprayers are well known in the art, only a portion of the trigger sprayer 14 with which the nozzle assembly 12 of the invention is used is shown in FIG. 1.

Contained inside the sprayer housing 16 is a tubular, vertical riser 22 shown at the right in FIG. 1. The lower end of the riser communicates with a dip tube (not shown) that extends downwardly into the liquid contained in the bottle container (not shown) to which the trigger sprayer 14 is attached. Together, the riser 22 and dip tube form a portion of the liquid supply passage that supplies the liquid of the container to the trigger sprayer pump chamber (not shown). As seen in FIG. 1, the upper end of the riser 22 is formed with an annular valve seat 24 on which rests a ball valve 26. The ball valve 26 and valve seat 24 form the check valve that controls the flow of liquid from the bottle container through the dip tube and riser 22 to the pump chamber, but prevent the reverse flow of liquid.

A vertical fluid conducting column 28 of the sprayer housing 16 surrounds the tubular riser 22. The interior passage of the fluid column 28 communicates with the trigger sprayer pump chamber. In addition, the interior of the fluid column 28 communicates with the liquid discharge passage 32 of the trigger sprayer defined by a tubular duct 34 of the sprayer housing 16. The tubular duct 34 has an inlet opening 36 at the right end of the duct as viewed in FIG. 1 that communicates the liquid discharge passage 32 within the duct with the liquid passage of the fluid column 28. An outlet opening 38 is provided at the opposite end of the duct 34. The duct 34 has a cylindrical interior surface 42 that surrounds the discharge passage 32. The inlet opening 36 and the outlet opening 38 are coaxial with a center axis 44 of the discharge passage 32. On operation of the trigger sprayer pump (not shown) liquid is drawn into the pump through the fluid column 28 and past the ball valve 26 and valve seat 24, and then is pumped to the liquid discharge passage 32 through the interior passage of the fluid column 28 and through the inlet opening 36 of the discharge passage.

Figures 2, 7:
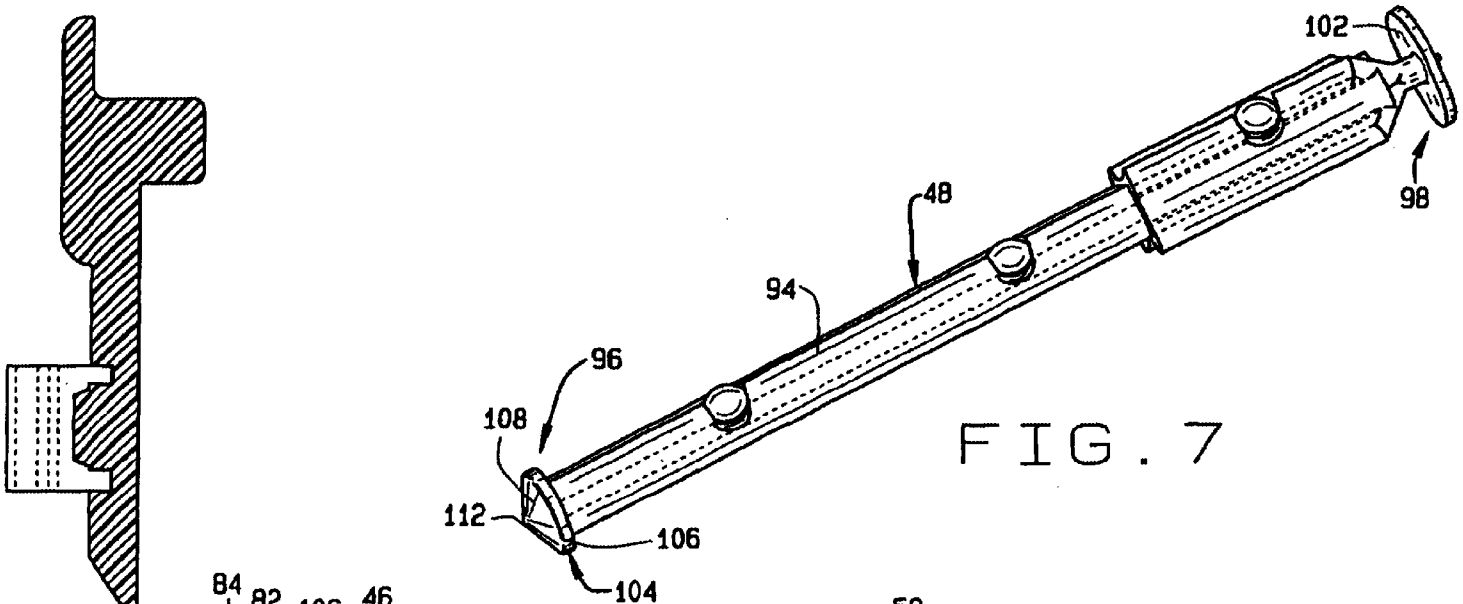
FIG. 2 is a side sectioned view of the sprayer nozzle assembly of the invention removed from the trigger sprayer liquid discharge passage.
Figure 4:
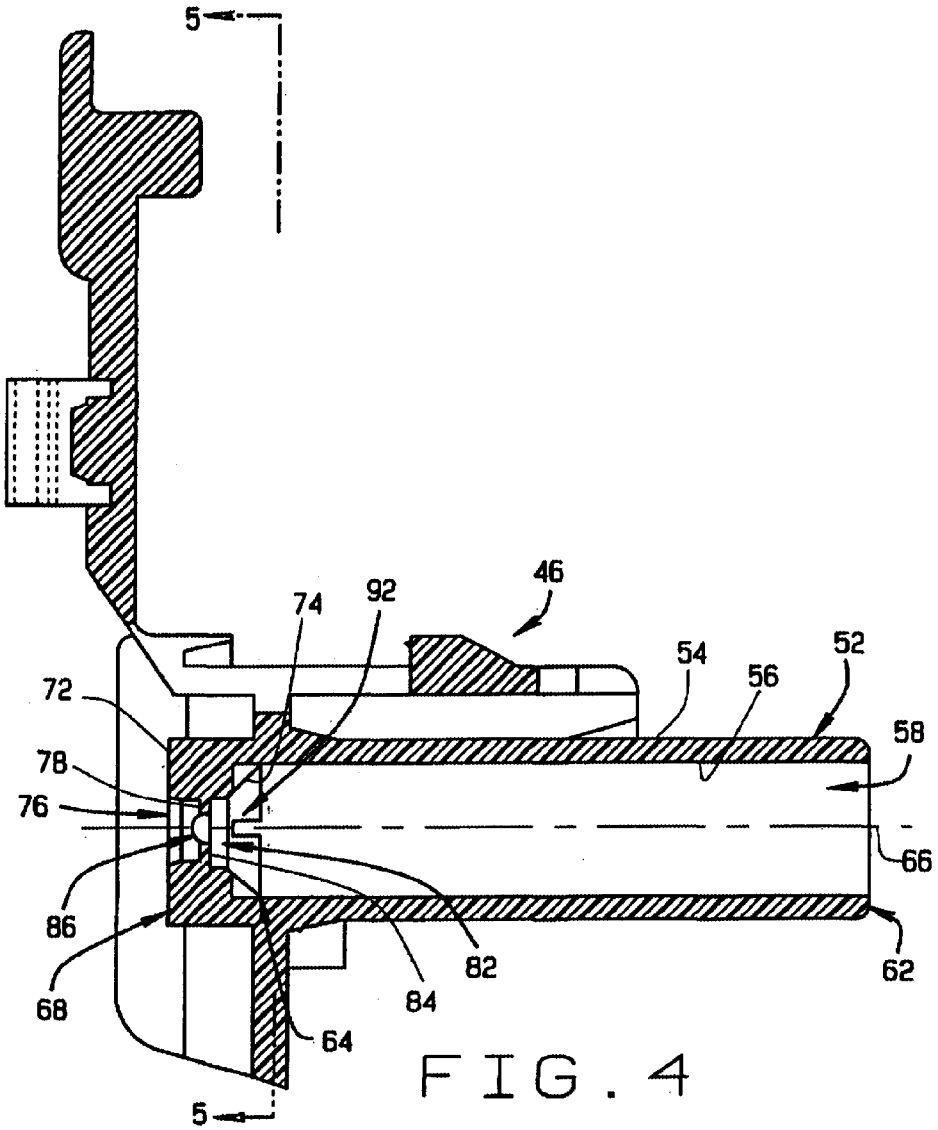
FIG. 4 is a side sectioned view of the nozzle housing of the nozzle assembly.
Figure 3:
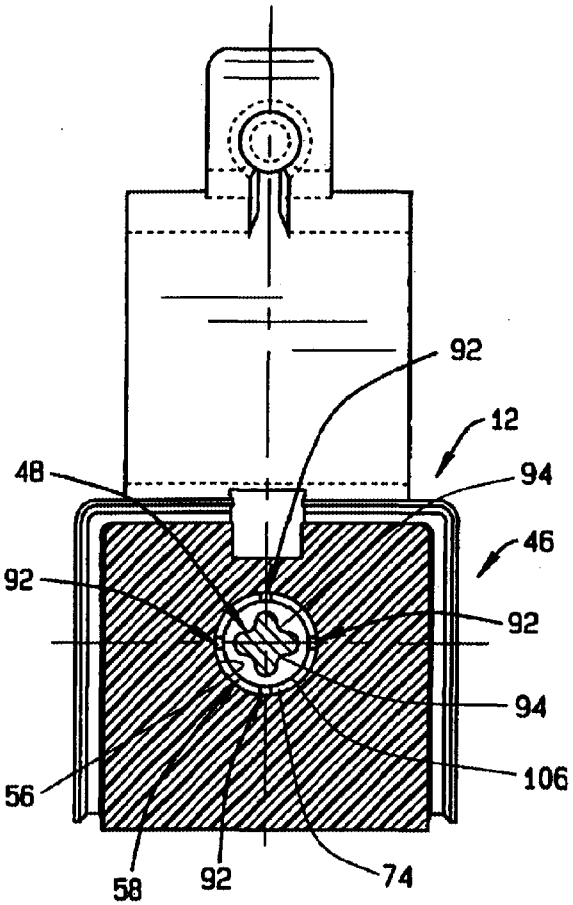
FIG. 3 is an end cross-sectioned view of the nozzle assembly of FIG. 2 from the plane of line 3—3 in FIG. 2.

The nozzle assembly 12 of the invention is shown assembled to the trigger sprayer 14 in FIG. 1, and is shown disassembled from the trigger sprayer in FIG. 2. The nozzle assembly 12 is basically comprised of the nozzle housing 46 and the fluid control member 48 contained in the nozzle housing. In the preferred embodiment, the nozzle housing and flow control member are both constructed of plastic. The nozzle assembly 12 of the invention is designed to be used with many types of manual handheld and operated sprayers having the typical construction of a trigger sprayer described earlier.

The nozzle housing 46 has a tubular conduit 52 with a cylindrical exterior surface 54 and a cylindrical interior surface 56. The conduit exterior surface 54 is dimensioned to fit through the discharge passage outlet opening 38 and tightly against the interior surface 42 of the discharge passage in mounting the nozzle housing 46 to the trigger sprayer 14. The conduit interior surface 56 defines a liquid passage 58 extending through the conduit from an upstream end 62 of the conduit to a downstream end 64 of the conduit. The conduit upstream end 62 is opened so that the conduit liquid passage 58 communicates with the discharge passage 32 of the trigger sprayer. The conduit 52 also has a center axis 66 that is coaxial with the center axis 44 of the trigger sprayer discharge passage.

The nozzle housing 46 also includes an orifice wall 68 at the conduit downstream end 64. The orifice wall 68 has an exterior surface 72 that faces the exterior environment of the trigger sprayer, and an opposite interior surface 74 inside the liquid passage 58 of the conduit. A cylindrical, exterior cavity 76 is recessed axially into the orifice wall exterior surface 72 to an exterior cavity surface 78 in the cavity. The cylindrical exterior cavity 76 is coaxial with the conduit center axis 66. On the opposite side of the orifice wall, a cylindrical interior cavity 82 is recessed axially into the orifice wall interior surface 74 to an interior cavity surface 84 in the orifice wall. The cylindrical interior cavity 82 is concentric with the conduit center axis 66.

Figure 6:
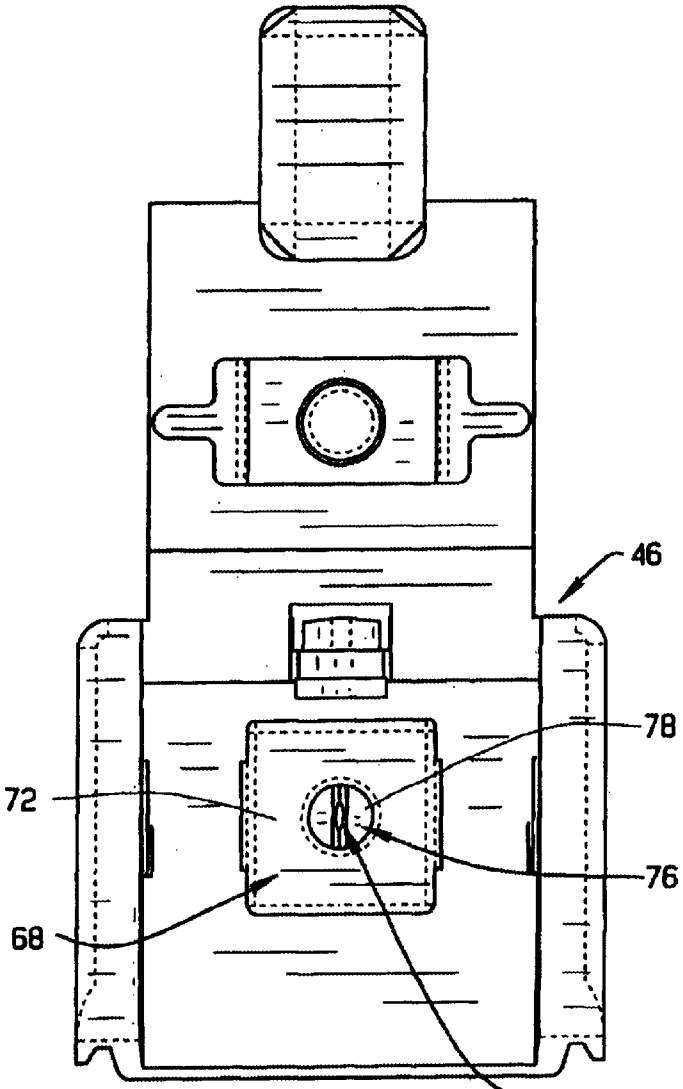
FIG. 6 is an end view of the nozzle housing from the plane of line 6—6 in FIG. 4; and, FIG. 7 is a perspective view of the flow control member of the nozzle assembly of the invention.
Figure 5:
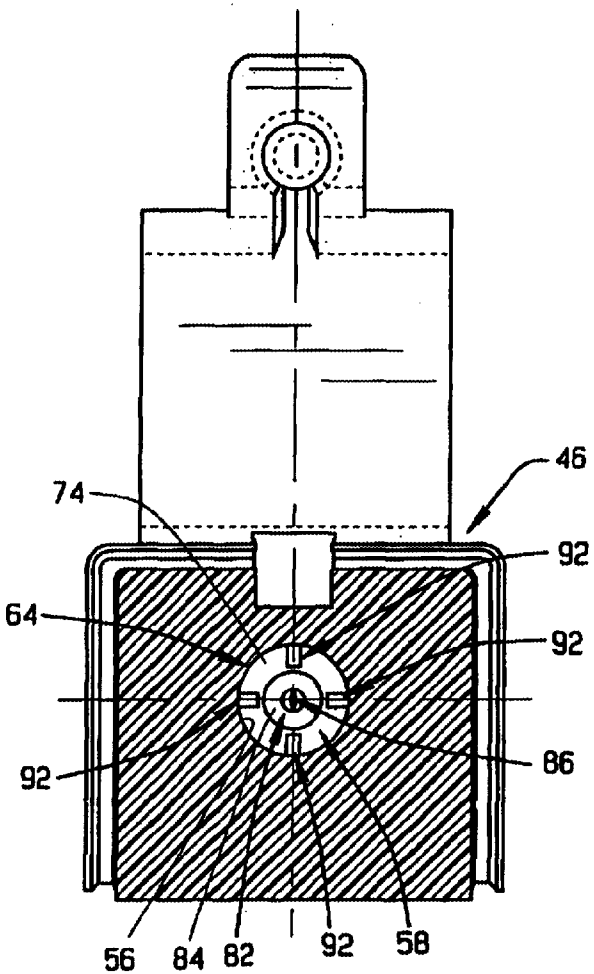
FIG. 5 is an end section view of the nozzle housing from the plane of line 5—5 of FIG. 4.

A liquid discharge orifice 86 passes through the reduced thickness portion of the orifice wall 68 between the exterior cavity 76 and the interior cavity 82. As best seen in FIGS. 5 and 6, the discharge orifice 86 has a cross sectional area that is oblong with a length of the discharge orifice being larger than a width of the discharge orifice. FIGS. 5 and 6 show the length of the discharge orifice 86 oriented vertically relative to the trigger sprayer 14. In a variant embodiment, the length of the discharge orifice 86 could be oriented horizontally relative to the trigger sprayer. The discharge orifice 86 is centered relative to the exterior cavity 76, the interior cavity 82 and the conduit center axis 66.

The portion of the orifice interior surface 74 that surrounds the interior cavity 82 is conical. As seen in FIGS. 1 and 2, as the interior surface 74 extends radially outwardly from the interior cavity 82 it also tapers axially toward the conduit upstream end 62. As best seen in FIG. 5, a plurality of slots 92 are formed axially into the orifice wall interior surface 74. The slots are circumferentially spaced around the conduit center axis 66 and extend radially outwardly from the interior cavity 82 to the conduit interior surface 56. As best seen in FIGS. 1 and 2, each of the slots 92 has a triangular interior area when viewed in cross section. As best seen in FIG. 5, at least a pair of the slots 92 are aligned with the oblong length of the discharge orifice 86. Each of the slots 92 forms a liquid channel directing the flow of liquid from the conduit liquid passage 58 toward the interior cavity 82 and the discharge orifice 86 as will be explained.

The fluid flow control member 48 is shown assembled in the nozzle housing 46 and trigger sprayer 14 in FIG. 1 and is shown removed from the nozzle housing and trigger sprayer in FIG. 7. The flow control member 48 has an elongate stem 94 with an axial length between a first, downstream end 96 of the member and a second, upstream 98 of the member. A valve element 102 in the form of a resilient disk valve is provided on the stem upstream end 98. The diameter of the valve element 102 is dimensioned to overlie the inlet opening 36 of the discharge passage 32. The valve element 102 also functions as a spring, exerting a pushing force on 35 the stem 94 to the left or in the downstream direction through passage 32. A flow control head 104 is provided at the first, downstream or opposite end 96 of the stem 94. The flow control head 104 has a circular peripheral surface 106 that gives the head a circular cross section. From the peripheral surface 106, the flow control head has a conical surface 108 that projects in a downstream direction from the stem to an apex 112 of the cone formed by the surface. With the fluid control member 48 positioned in the trigger sprayer discharge passage 32 and the nozzle housing conduit 52, the length of the stem 94 positions the valve element 102 against the discharge passage inlet opening 36 and positions the head conical surface 108 in engagement with the orifice wall conical interior surface 74. The head conical surface projects in a downstream axial direction to the apex 112 of the surface that is positioned in the volume of the orifice wall interior cavity 82. The engagement of the periphery of the head conical surface 108 with the orifice wall conical interior surface 74 causes the head conical surface 108 to extend over portions of the radially extending slots 92 formed in the orifice wall interior surface 74. This defines a plurality of fluid flow breakup channels in the conduit liquid passage 58 that extend from the peripheral surface 106 of the flow control head, through the plurality of slots 92 and across the conical surface 108 of the flow control head toward the discharge orifice 86. In the example of the preferred embodiment of the invention, the four radially extending slots 92 will break up fluid flow through the discharge passage 32 and conduit liquid passage 58 into four streams of liquid that are directed toward each other and impact adjacent the apex 112 of the flow control head conical surface 108.

In operation of the trigger sprayer 14 employing the nozzle assembly 12 of the invention, viscous liquid is pumped from the pump chamber (not shown) of the sprayer upwardly through the annular space between the housing fluid column 28 and the tubular riser 22. The viscous liquid passes through the inlet opening 36 of the sprayer discharge passage 32 and unseats the valve element 102 of the flow control member. The viscous liquid enters the discharge passage 32 and flows in a downstream direction or to the left as viewed in FIG. 1 over the exterior surface of the stem 94 of the flow control member toward the flow control head 104 at the downstream end of the flow control member. The peripheral surface 106 of the flow control head directs the flow of liquid around the head and the liquid enters the plurality of slots 92 in the orifice wall conical interior surface 74 at the periphery of the flow control head. The conical surface 108 of the flow control head engaging with the orifice wall conical interior surface 74 directs the flow of liquid through the plurality of liquid flow channels formed by the radial slots 92 in the orifice wall. Thus, the flow control head 104 and the plurality of liquid flow channels formed by the slots 92 initially break up the flow of viscous fluid into several streams, in this example four streams, spatially arranged around the discharge orifice 86 and moving toward the orifice. These several separate streams of liquid are further directed by the flow control head conical surface 108 and the plurality of slots 92 toward the conical surface apex 112 where the pluralities of liquid streams impact or collide with each other inside the interior cavity 82 of the orifice wall 68. The impact of the liquid streams inside the orifice wall interior cavity 82 occurs at the entrance to the discharge orifice 86. The impact or collision of the liquid streams at the entrance to the discharge orifice 86 causes the liquid to disburse as it passes into the orifice and the dispersion of the liquid is shaped by the oblong configuration of the orifice as the liquid passes through the orifice. The oblong or rectangular configuration of the orifice 86 forms the dispersion pattern of the liquid into a narrow fan spray pattern oriented uprightly or vertically relative to the trigger sprayer held in the hand of the user. In the alternate embodiment where the oblong shape of the discharge orifice 86 is positioned horizontally, the dispersion pattern of the liquid would be a narrow fan spray pattern oriented horizontally relative to the trigger sprayer held in the hand of the user.

From the operation of the liquid spray nozzle assembly 12 of the invention described above, the nozzle assembly disperses viscous liquid in a more uniform fan sprayed pattern that is easily employed by the user of the nozzle assembly and trigger sprayer to which it is attached to direct the spray of viscous liquid where desired.

While the present invention has been described by reference to a specific embodiment, it should be understood that modifications and variations of the invention may be constructed without departing from the scope of the invention defined in the following claims.

What is claimed:

1. A sprayer apparatus comprising:

a sprayer housing having a liquid conduit extending therethrough, the conduit having a length with opposite upstream and downstream ends and a liquid passage surrounded by an interior surface that extend through the conduit between the upstream and downstream ends, the liquid passage having a center axis;

an orifice wall on the sprayer housing at the conduit downstream end, the orifice wall having an interior surface that opposes the conduit liquid passage;

an orifice through the orifice wall that communicates the conduit liquid passage with an exterior environment of the sprayer housing;

a plurality of slots in the orifice wall interior surface that are arranged around the orifice and radiate outwardly from the orifice, each of the slots having a center line that intersects a center axis of the orifice;

a flow control member in the conduit liquid passage, the flow control member having an axial length with a head at one end that engages against the orifice wall interior surface, the flow control member head having a conical surface that engages against the orifice wall interior surface.

2. The apparatus of claimed 1, further comprising:

the flow control member head having a circular cross section and the head engaging over the plurality of slots in the orifice wall interior surface.

3. The apparatus of claims 1, further comprising:

the flow control member having a valve element at an opposite end of the flow control member length from the head.

4. The apparatus of claim 1, further comprising:

the orifice wall interior surface being conical.

5. A sprayer apparatus comprising:

a sprayer housing having a liquid conduit extending therethrough, the conduit having a length with opposite upstream and downstream ends and a liquid passage surrounded by an interior surface that extend through the conduit between the upstream and downstream ends, the liquid passage having a center axis;

an orifice wall on the sprayer housing at the conduit downstream end, the orifice wall having an interior surface that opposes the conduit liquid passage;

an orifice through the orifice wall that communicates the conduit liquid passage with an exterior environment of the sprayer housing, the orifice having an oblong shape with a width dimension and a length dimension, the length dimension being larger than the width dimension;

a plurality of slots in the orifice wall interior surface;

a flow control member in the conduit liquid passage, the flow control member having an axial length with one end positioned adjacent the downstream end of the conduit and an opposite end positioned adjacent the upstream end of the conduit;

the plurality of slots comprising a pair of slots that are aligned with the orifice length; and, the plurality of slots comprising a pair of slots that are positioned transverse to the orifice length.

6. The apparatus of claim 5, further comprising:

the flow control member having a head at the one end of the flow control member, the head engaging with the orifice wall interior surface and extending over the plurality of slots.

7. The apparatus of claim 6, further comprising:

the head having a conical surface that engages with the orifice wall and extends over the plurality of slots.

8. The apparatus of claim 6, further comprising:

the flow control member having a valve element at the opposite end of the flow control member.

9. The apparatus of claim 5, further comprising:

the orifice wall interior surface being a conical surface.

10. A sprayer apparatus comprising:

a sprayer housing having a liquid conduit extending therethrough, the conduit having a length with opposite upstream and downstream ends and a liquid passage surrounded by an interior surface that extend through the conduit between the upstream and downstream ends, the liquid passage having a center axis;

an orifice wall on the sprayer housing at the conduit downstream end, the orifice wall having a conical interior surface that opposes the conduit liquid passage;

a cylindrical cavity recessed axially into the orifice wall interior surface to a cavity interior surface on the orifice wall;

an orifice in the cavity interior surface and extending through the orifice wall; and, a flow control member in the conduit liquid passage, the flow control member having an axial length with one end positioned adjacent the downstream end of the conduit and an opposite end positioned adjacent the upstream end of the conduit.

11. The apparatus of claim 10, further comprising:

the flow control member having a head at the one end, the head engaging with the orifice wall conical interior surface.

12. The apparatus of claim 11, further comprising:

the flow control head having a conical surface engaging with the conical interior surface of the orifice wall.

13. The apparatus of claim 11, further comprising:

the flow control member having a valve element at the opposite end.

14. The apparatus of claim 10, further comprising:

a plurality of slots in the orifice wall interior surface that are arranged around the cavity.

15. The apparatus of claim 14, further comprising:

each slot extends radially between the cavity and the conduit interior surface.

16. The apparatus of claim 14, further comprising:

the flow control member having a head with a conical surface, the head conical surface engaging against the orifice wall conical interior surface and extending across the plurality of slots.

17. A sprayer apparatus comprising:

a sprayer housing having a liquid conduit extending therethrough, the conduit having a length with opposite upstream and downstream ends and a liquid passage surrounded by an interior surface that extend through the conduit between the upstream and downstream ends, the liquid passage having a center axis;

an orifice wall on the sprayer housing at the conduit downstream end, the orifice wall having a conical interior surface that opposes the conduit liquid passage;

an orifice through the orifice wall that communicates the conduit liquid passage with an exterior environment of the sprayer housing; and, a flow control member in the conduit liquid passage, the flow control member having an axial length with a head at one end, the head having a conical surface that engages against the orifice wall conical interior surface.

18. The apparatus of claim 17,further comprising:

a valve element on the flow control member opposite the head.

19. The apparatus of claim 17, further comprising:

the orifice having an oblong shape.

20. The apparatus of claim 17, further comprising:

a cylindrical cavity recessed axially into the orifice wall interior surface to a cavity interior surface on the orifice wall, the orifice being in the cavity.

21. The apparatus of claim 20, further comprising:

the flow control member head conical surface having a apex positioned in the cavity.

22. A sprayer apparatus comprising:

a sprayer housing having a liquid conduit extending therethrough, the conduit having an axial length with opposite upstream and downstream ends and a liquid passage surrounded by an interior surface that extend through the conduit between the upstream and downstream ends, the liquid passage having a center axis;

a an orifice wall on the sprayer housing at the conduit downstream end, the orifice wall having an interior surface that opposes the conduit liquid passage;

a cylindrical cavity recessed axially into the orifice wall interior surface to a cavity interior surface on the orifice wall;

an orifice in the cavity interior surface and extending through the orifice wall; and a flow control member in the conduit liquid passage, the flow control member having an axial length with one end positioned adjacent the downstream end of the conduit and an opposite end positioned adjacent the upstream end of the conduit, the one end of the flow control member having a conical surface with an apex and the apex being positioned in the cavity.

23. The apparatus of claim 22, further comprising:

a valve element on the opposite end of the flow control member.

24. The apparatus of claim 22, further comprising:

the conical surface of the flow control member engaging with the orifice wall interior surface.

25. The apparatus of claim 24, further comprising:

a plurality of slots in the orifice wall interior surface that extend radially outwardly from the cavity.

26. The apparatus of claim 25, further comprising: the conical surface of the flow control member extending over the slots.

27. The apparatus of claim 22, further comprising: the orifice having an oblong shape.

* * * * *